US007532855B2

(12) United States Patent
Kajita

(10) Patent No.: US 7,532,855 B2
(45) Date of Patent: May 12, 2009

(54) IMAGE FORMING APPARATUS

(75) Inventor: Masahito Kajita, Kasugai (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 450 days.

(21) Appl. No.: 11/340,557

(22) Filed: Jan. 27, 2006

(65) Prior Publication Data

US 2006/0165455 A1 Jul. 27, 2006

(30) Foreign Application Priority Data

Jan. 27, 2005 (JP) ..... 2005-019968

(51) Int. Cl.
*G03G 15/00* (2006.01)

(52) U.S. Cl. ..... 399/406; 399/405

(58) Field of Classification Search ..... 399/406, 399/405

See application file for complete search history.

(56) References Cited

U.S. PATENT DOCUMENTS

| | | | | |
|---|---|---|---|---|
| 5,287,157 | A | 2/1994 | Miyazato et al. | |
| 5,528,345 | A * | 6/1996 | Hasegawa | 399/122 |
| 5,867,181 | A * | 2/1999 | Nakane et al. | 347/2 |
| 6,246,860 | B1 | 6/2001 | Ohmichi | |
| 6,338,481 | B1 * | 1/2002 | Maruchi | 271/188 |
| 2002/0109289 | A1 | 8/2002 | Oikawa | |
| 2003/0007817 | A1 | 1/2003 | Saitoh | |
| 2003/0147681 | A1 | 8/2003 | Suenaga | |

FOREIGN PATENT DOCUMENTS

| | | |
|---|---|---|
| EP | 1 231 521 A2 | 8/2002 |
| JP | 63-315275 | 12/1988 |
| JP | 4-338060 | 11/1992 |
| JP | 5-208773 | 8/1993 |
| JP | 7-101612 A | 4/1995 |
| JP | 7-179258 A | 7/1995 |
| JP | 8-309967 | 11/1996 |
| JP | 9-142711 A | 6/1997 |
| JP | 9-208102 A | 8/1997 |

(Continued)

OTHER PUBLICATIONS

Japanese Office Action, with English translation, issued in Japanese Patent Application No. JP 2005-019968, mailed Jul. 10, 2007.

*Primary Examiner*—Anthony H. Nguyen
(74) *Attorney, Agent, or Firm*—McDermott Will & Emery LLP

(57) ABSTRACT

An image forming apparatus including: an apparatus main body; a discharge roller portion that discharges sheet members; a tray being capable of stacking the sheet members discharged from the discharge roller portion; and a curl correcting member being capable of arranging on a downstream side in a sheet member carrying direction of the discharge roller portion, brought into contact with the sheet member having a curl convex upwardly and discharged from the discharge roller portion, and having a correcting face for exerting a correcting force to a side of correcting the curl. The curl of the sheet member is corrected by the curl correcting member when the curl correcting member is arranged on the downstream side of the discharge roller portion, and is not corrected by the curl correcting member when the curl correcting member is not arranged on the downstream side of the discharge roller portion.

9 Claims, 9 Drawing Sheets

FOREIGN PATENT DOCUMENTS

| | | |
|---|---|---|
| JP | 10-87142 | 4/1998 |
| JP | 2000-247526 | 9/2000 |
| JP | 2001-316016 | 11/2001 |
| JP | 2002-96961 | 4/2002 |
| JP | 2002-220160 | 8/2002 |
| JP | 3370503 | 11/2002 |

* cited by examiner

IMAGE FORMING APPARATUS

CROSS REFERENCE TO RELATED APPLICATION

This application claims priority from Japanese Patent Application No. 2005-019968, filed on Jan. 27, 2005, the entire subject matter of which is incorporated herein by reference.

TECHNICAL FIELD

Aspects of the present invention relate to an image forming apparatus including a laser printer or the like.

BACKGROUND

In an image forming apparatus such as a copier and a laser printer using an electronic photography system, there is a case in which a sheet (sheet member) is curled (warped) during fixing an image. When a sheet is discharged onto a tray in a state of being curled, there is brought about a drawback that sheet stacking characteristics are deteriorated, and the sheet discharged onto the tray is pushed by a successively discharged sheet to drop from the tray. Hence, in a background art, there has been proposed a constitution in which a discharge roller portion of discharging a sheet onto a tray is provided with a function of correcting a curl produced at the sheet. For example, according to a constitution disclosed in JP-A-7-101612, a discharge roller portion includes a correcting roller driven to rotate, a pair of pressing rollers opposed to the correcting roller, and a spring member for urging the pressing roller to a side of the correcting roller. A sheet is warped back to a side inverse to a direction of curling the sheet by being carried along an outer circumferential face of the correcting roller while being pinched by the three rollers and the curl is corrected.

SUMMARY

However, according to the above-described discharge roller, even when a curl of an ordinary sheet can be removed, in a case of an inflexible sheet of a postcard or the like, there is a case in which the curl cannot be removed sufficiently. When a curl correcting force is increased by intensifying an urging force of the spring portion, a curl of the inflexible sheet can be removed. In this case, however, there is a concern that an excessive stress is applied to a comparatively flexible sheet of an ordinary sheet.

Aspects of the invention provide an image forming apparatus capable of exerting an appropriate curl correcting force to a plurality of kinds of sheets (sheet members).

According to an aspect of the invention, there is provided an image forming apparatus including: an apparatus main body; a discharge roller portion that discharges sheet members; a tray being capable of stacking the sheet members discharged from the discharge roller portion; and a curl correcting member being capable of arranging on a downstream side in a sheet member carrying direction of the discharge roller portion, brought into contact with the sheet member having a curl convex upwardly and discharged from the discharge roller portion, and having a correcting face for exerting a correcting force to a side of correcting the curl; wherein the curl of the sheet member is corrected by the curl correcting member when the curl correcting member is arranged on the downstream side of the discharge roller portion, and is not corrected by the curl correcting member when the curl correcting member is not arranged on the downstream side of the discharge roller portion.

The curl correcting force exerted to the sheet member can appropriately be adjusted by arranging the curl correcting member on the downstream side of the discharge roller portion for the sheet member which is inflexible and needs the large curl correcting force and removing the curl correcting member from the downstream side of the discharge roller portion for the other sheet member. Thereby, the pertinent curl correcting force can be exerted to a plurality of kinds of the sheet members.

BRIEF DESCRIPTION OF THE DRAWINGS

Illustrative aspects of the invention may be more readily described with reference to the accompanying drawings.

DETAILED DESCRIPTION

Aspects of the invention will be described below with reference to FIG. 1 through FIG. 9.

1. Overall Constitution of Laser Printer

Figure 1:
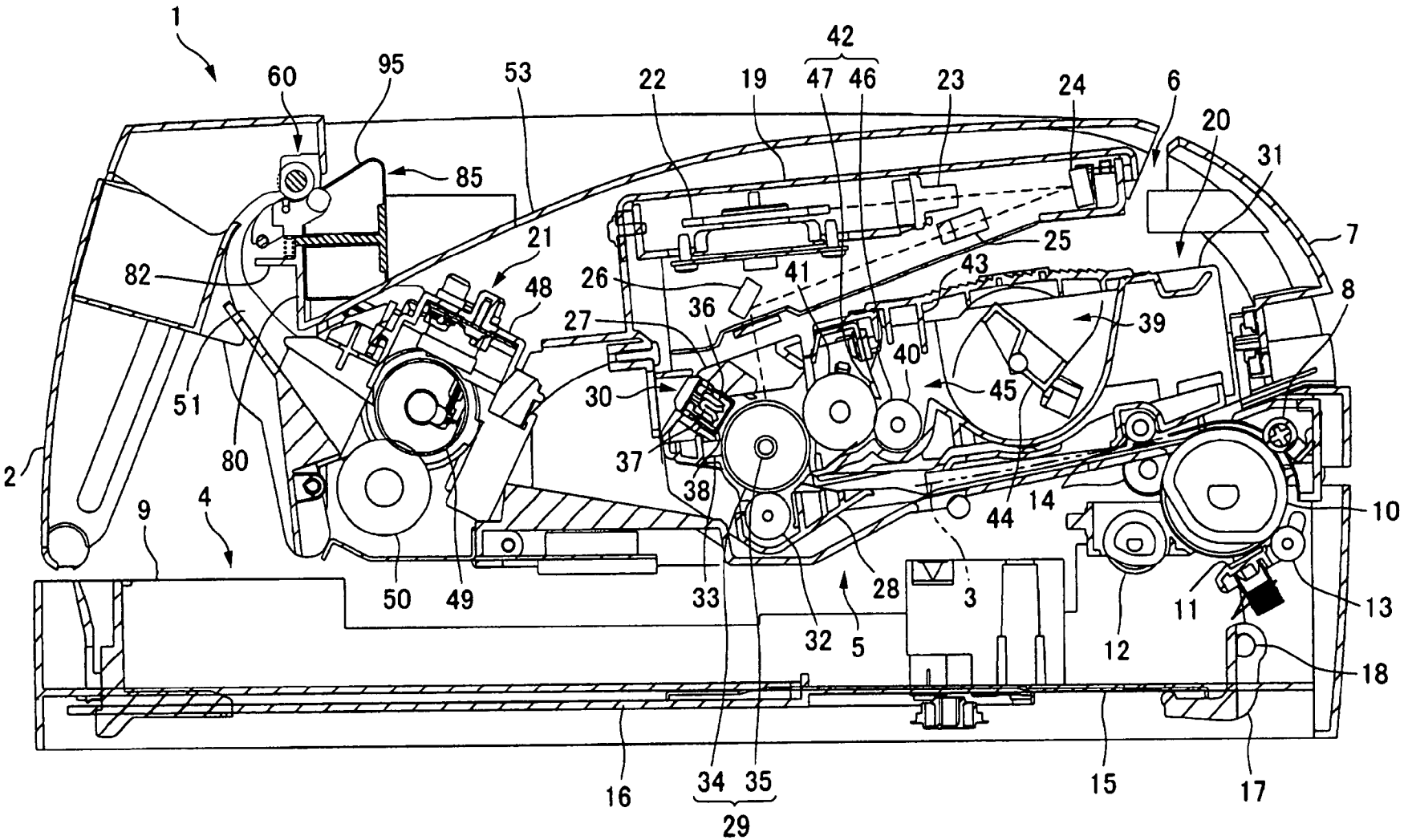
FIG. 1 is a side sectional view showing a portion of a laser printer as an image forming apparatus according to an aspect of the invention.
Figure 2:
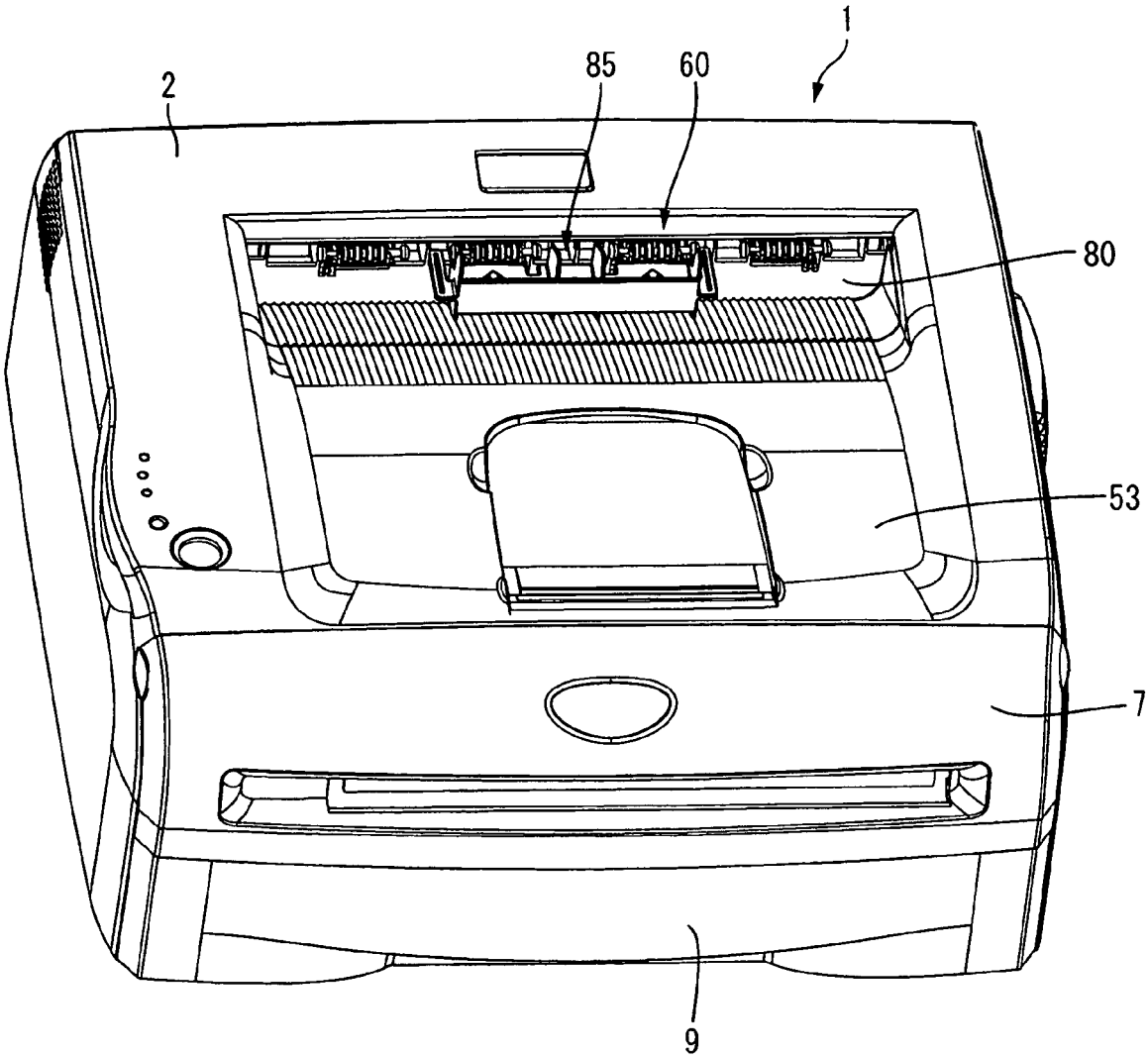
FIG. 2 is a perspective view showing an outer appearance of the laser printer.

FIG. 1 is a side sectional view showing a laser printer as an image forming apparatus and FIG. 2 is a perspective view of an outer appearance of the laser printer. The laser printer 1 is provided with a main body casing 2 as an apparatus main body, a feeder portion 4 contained at inside of the main body casing 2 for feeding a sheet 3 as a sheet member, an image forming portion 5 for forming an image on the fed sheet 3 and the like. In the following explanation, the right side of FIG. 1 is referred to as a front side, and the direction perpendicular to the sheet of FIG. 1 is referred to as a left and right direction.

(1) Main Body Casing

A front face of the main body casing 2 is formed with an attaching/detaching port 6 for attaching and detaching a process cartridge 20, mentioned later, and is provided with a front cover 7 for opening and closing the attaching/detaching port 6. The front cover is pivotably supported by a cover shaft (not illustrated) inserted into a lower end portion thereof. When the front cover 7 is closed centering on the cover shaft, as shown in FIG. 1, the attaching/detaching port 6 is closed by the front cover 7. When the front cover 7 is opened (inclined) by constituting an fulcrum by the cover shaft, the attaching/ detaching port 6 is opened, and the process cartridge 20 can be attached to and detached from the main body casing 2 through the attaching/detaching port 6. Further, an upper face of the main body casing 2 is provided with a sheet discharge tray 53 on which the sheet 3 after forming an image thereon is stacked.

(2) Feeder Portion

The feeder portion 4 is provided with a sheet feeding tray 9 detachably mounted to a bottom portion at inside of the main body casing 2, a sheet feeding roller 10 and a separating pad 11 provided on an upper side of a front end portion of the sheet feeding tray 9, a pickup roller 12 provided on a rear side of the sheet feeding roller 10, a pinch roller 13 arranged opposedly to a lower side of a front side of the sheet feeding roller 10, a paper powder removing roller 8 arranged opposedly to an upper side of a front side of the sheet feeding roller 10, and a registration roller 14 provided on an upper side of a rear side of the sheet feeding roller 10.

Inside of the sheet feeding tray 9 is provided with a sheet pressing plate 15 capable of stacking sheets 3 in a piled state. The sheet pressing plate 15 is made to be pivotable between a mounting position at which a front side end portion thereof is arranged on a lower side along a bottom plate 16 of the sheet feeding tray 9 and an inclined carrying position at which the front end portion is arranged on an upper side by being pivotably supported at a rear end portion thereof.

Further, the front end portion of the sheet feeding tray 9 is provided with a lever 17 for lifting the front end portion of the sheet pressing tray 15 to an upper side. The lever 17 is formed substantially in the shape of letter L in a section thereof to be extended around from a front side to a lower side of the sheet pressing plate 15. The upper end portion of the lever is attached to a lever shaft 18 provided at the front end portion of the sheet feeding tray 9, and a rear end portion thereof is brought into contact with a front end portion of a lower face of the sheet pressing plate 15. When the lever shaft 18 is inputted with a rotational drive force in the clockwise direction of the drawing, the lever 17 is rotated by constituting a fulcrum by the lever shaft 18. The rear end portion of the lever 17 lifts the front end portion of the sheet pressing plate 15 and the sheet pressing plate 15 is disposed at the carrying position.

When the sheet pressing plate 15 is disposed at the carrying position, the sheet 3 on the sheet pressing plate 15 is pressed to the pickup roller 12 and is started to be carried to between the sheet feeding roller 10 and the separating pad 11 by rotating the pickup roller 12.

On the other hand, when the sheet feeding tray 9 is detached from the main body casing 2, the front side end portion of the sheet pressing plate 15 is moved to a lower side by its own weight and the sheet pressing plate 15 is disposed at the mounting position. When the sheet pressing plate 15 is disposed at the mounting position, the sheets 3 can be mounted above the sheet pressing plate 15 in the piled state.

When the sheet 3 fed to between the sheet feeding roller 10 and the separating pad 11 by the pickup roller 12 is pinched between the sheet feeding roller 10 and the separating pad 11 by rotating the sheet feeding roller 10, the sheet is fed while being firmly separated sheet by sheet. The fed sheet 3 passes through between the sheet feeding roller 10 and the pinch roller 13, removed of paper powder by the paper powder removing roller 8 and thereafter carried to the registration roller 14.

The registration roller 14 is constituted by a pair of rollers for carrying the sheet 3 to between a photosensitive drum 29 and a transfer roller 32, mentioned later, and to a transfer position at which a toner image on the photosensitive drum 29 is transferred onto the sheet 3 after registration.

(3) Image Forming Portion

The image forming portion 5 is provided with a scanner portion 19, the process cartridge 20, a fixing portion 21.

(a) Scanner Portion

The scanner portion 19 is provided at an upper portion at inside of the main body casing 2 and is equipped with a laser beam source, not illustrated, a polygon mirror 22 which is driven to rotate, an fθ lens 23, a reflecting mirror 24, a lens 25 and a reflecting mirror 26. As indicated by a chain line, a laser beam based on image data emitted from the laser beam source is deflected by the polygon mirror 22, passes through the fθ lens 23, and an optical path thereof is folded back by the reflecting mirror 24. The laser beam further passes through the lens 25 and thereafter, the optical path is further flexed to a lower side by the reflecting mirror 26. Thereby, the laser beam is irradiated onto a surface of the photosensitive drum 29, mentioned later, of the process cartridge 20.

(b) Process Cartridge

The process cartridge 20 is detachably mounted to the main body casing 2 on a lower side of the scanner portion 19. The process cartridge 20 is provided with an upper frame 27 as a first frame, and a lower frame 28 as a second frame formed separately from the upper frame 27 and combined with the upper frame 27 as a cabinet. Further, the process cartridge 20 is provided with the photosensitive drum 29 as an image carrier, a scorotron charger 30, a developing cartridge 31, the transfer roller 32, and a cleaning brush 33 at inside oft the cabinet.

The photosensitive drum 29 is provided with a drum main body 34 formed in a cylindrical shape. A topmost layer of the photosensitive drum 29 is formed by a positively charging photosensitive layer made of polycarbonate or the like. A drum shaft 35 made of a metal as a shaft extended along a longitudinal direction of the drum main body 34 at an axis center of the drum main body 34 is further provided. By supporting the drum shaft 35 by the upper frame 27 and rotatably supporting the drum main body 34 by the drum shaft 35, the photosensitive drum 29 is rotatably provided centering on the drum shaft 35 in the upper frame 27.

The scorotron type charger 30 is supported by the upper frame 27 and is arranged to be opposed to the photosensitive drum 29 by being spaced apart with a predetermined interval therebetween so as not to be brought into contact with the photosensitive drum 29 on a skewed upper side of a rear side of the photosensitive drum 29. The scorotron type charger 30 is provided with a discharging wire 37 arranged to be opposed to the photosensitive drum 29 by being spaced apart with a predetermined interval therebetween in an axial direction of the photosensitive drum 29, and a grid 38 provided between the discharging wire 37 and the photosensitive drum 29 for controlling an amount of discharging electricity from the discharging wire 37 to the photosensitive drum 29. The scorotron type charger 30 can charge a surface of the photosensitive drum 29 uniformly in a positive polarity by making the discharging wire 37 discharged by corona discharge by applying a high voltage to the discharge wire 37 simultaneously with applying a bias voltage to the grid 38.

Further, the scorotron type charger 30 is provided with a cleaning member 36 for cleaning the discharging wire 37 to pinch the discharging wire 37.

The developing cartridge 31 is formed in a shape of a box a rear side of which is opened and is detachably mounted to the lower frame 28. Inside of the developing cartridge 31 is provided with a toner containing chamber 39, a supply roller 40, a developing roller 41 and a layer thickness restricting blade 42.

The toner containing chamber 39 is formed as an inner space on a front side of the developing cartridge 31 partitioned by a partitioning plate 43. Inside of the toner containing chamber 39 is filled with a toner of a positively charging non-magnetic mono-component. As a toner, there is used a polymerized toner by polymerizing a polymerizing monomer, for example, a styrene species monomer of styrene or the like, acrylic species monomer of acrylic acid, alkyl (C1 through C4) acrylate, alkyl (C1 through C4) metaacrylate or the like by suspension polymerization or the like. Such a polymerized toner is constituted substantially by a spherical shape, extremely excellent in a fluidity and can achieve to form an image having a high image quality.

Further, a toner is blended with a colorant of carbon black or wax or the like, further, added with an externally added agent of silica or the like to promote the fluidity. A mean particle size of the toner is about 6 through 10 μm.

Further, inside of the toner containing chamber 39 is provided with an agitator 44. The toner at inside of the toner containing chamber 39 is agitated by the agitator 44 and is discharged from an opening portion 45 communicated in a front and rear direction on a lower side of the partitioning plate 43 to the supply roller 40.

The supply roller 40 is arranged on a rear side of the opening portion 45 and is rotatably supported by the developing cartridge 31. The supply roller 40 is constituted by covering a roller shaft made of a metal by a roller made of a conductive foamed material. The supply roller 40 is driven to rotate by inputting power from a motor, not illustrated.

The developing roller 41 is rotatably supported by the developing cartridge 31 in a state of being brought into contact with the supply roller 40 to be compressed by each other on a rear side of the supply roller 40. Further, the developing roller 41 is opposed to be brought into contact with the photosensitive drum 29 in a state of mounting the developing cartridge 31 to the lower frame 28. The developing roller 41 is constituted by covering a roller shaft made of a metal by a roller made of a conductive rubber material. According to the roller of the developing roller 41, a surface of a roller main body made of conductive urethane rubber or silicone rubber including fine carbon powders is covered with a coating layer of urethane rubber or silicone rubber including fluorine. The developing roller 41 is applied with a developing bias in developing. Further the developing roller 41 is driven to rotate in a direction the same as that of the supply roller 40 by inputting power from a motor, not illustrated.

The layer thickness restricting blade 42 is provided with a pressing portion 47 having a section in a semicircular shape and made of insulting silicone rubber at a front end portion of the blade main body 46 made of a metal leaf spring member. The layer thickness restricting blade 42 is supported by the developing cartridge 31 on an upper side of the developing roller 41 and the pressing portion 47 is brought into press contact with the developing roller 41 by an elastic force of the blade main body 46.

A toner discharged from the opening portion 45 is supplied to the developing roller 41 by rotating the supply roller 40 and is charged positively by a friction between the supply roller 40 and the developing roller 41 at this occasion. The toner supplied onto the developing roller 41 advances to between the pressing portion 47 of the layer thickness restricting blade 42 and the developing roller 41 in accordance with rotation of the developing roller 41 and is carried on the developing roller 41 as a thin layer having a constant thickness.

The transfer roller 32 is rotatably supported by the lower frame 28, opposed to be brought into contact with the photosensitive drum 29 in an up and down direction in a state of combining the upper frame 27 and the lower frame 28 and arranged to form a nip between the transfer roller 32 and the photosensitive drum 29. The transfer roller 32 is constituted by covering a roller shaft made of a metal by a roller made of a conductive rubber material. The transfer roller 32 is applied with a transfer bias in transferring. The transfer roller 32 is driven to rotate in a direction inverse to that of the photosensitive drum 29 by inputting power from a motor, not illustrated.

The cleaning brush 33 is attached to the lower frame 28 and is arranged to be opposed to be brought into contact with the photosensitive drum 29 on a rear side of the photosensitive drum 29 in a state of combining the upper frame 27 and the lower frame 28.

The surface of the photosensitive drum 29 is, first, uniformly charged positively by the scorotron type charger 30 in accordance with rotation of the photosensitive drum 29 and thereafter exposed by high speed scanning of the laser beam from the scanner portion 19 and is formed with an electrostatic latent image in correspondence with an image to be formed on the sheet 3.

Subsequently, when the toner carried on the developing roller 41 and charged positively is opposed to be brought into contact with the photosensitive drum 29 by rotating the developing roller 41, the toner is supplied to the exposed portion formed on the surface of the photosensitive drum 29, that is, an exposed portion which is exposed by the laser beam and a potential of which is lowered in the surface of the photosensitive drum 29 uniformly charged positively. Thereby, the electrostatic latent image of the photosensitive drum 29 is visualized and a toner image by inversion development is carried on the surface of the photosensitive drum 29.

Thereafter, as shown in FIG. 1, the toner image carried on the surface of the photosensitive drum 29 is transferred onto the sheet 3 by the transferring bias applied to the transfer roller 32 during a time period in which the sheet 3 carried by the registration roller 14 passes a transfer portion between the photosensitive drum 29 and the transfer roller 32. The sheet 3 transferred with the toner image is carried to the fixing portion 21.

Further, a remaining toner which remains on the photosensitive drum 29 after transfer is recovered by the developing roller 41. Further, paper powder from the sheet 3 adhered onto the photosensitive drum 29 after transfer is recovered by the cleaning brush 33.

(c) Fixing Portion

The fixing portion 21 is provided on a rear side of the process cartridge 20 and is provided with a fixing frame 48. Further, a heating roller 49 and a pressing roller 50 are provided at inside of the fixing frame 48.

The heating roller 49 is provided with a metal tube a surface of which is coated by fluororesin and a halogen lamp for heating at inside of the metal tube and is driven to rotate by inputting power from a motor, not illustrated.

The pressing roller 50 is arranged on a lower side of the heating roller 49 to be opposed thereto to press the heating roller 49. The pressing roller 50 is constituted by coating a roller shaft made of a metal by a roller made of a rubber material and is driven by rotation of the heating roller 49.

At the fixing portion 21, the toner transferred onto the sheet 3 at the transfer position is thermally fixed during a time period of passing the sheet 3 between the heating roller 49 and the pressing roller 50. Further, the sheet 3 fixed with the toner is carried to a sheet discharging path 51 extended to be bent substantially in a U-like shape in a section thereof to an upper face of the main body casing 2. The sheet 3 carried to the sheet discharging path 51 is discharged onto the sheet discharging tray 53 by a discharge roller portion 60 provided at an upper end position of the sheet discharging path 51.

2. Sheet Discharge Tray, Discharge Roller Portion and Curl Correcting Member

As described above, the sheet 3 transferred with the toner image is carried to the fixing portion 21 and is thermally fixed during a time period of passing between the heating roller 49 and the pressing roller 50. During the fixing operation, there is a case in which the sheet 3 is curled (warped) to a side of the heating roller 49 by evaporating moisture of a face of the sheet 3 opposed to the heating roller 49. Or, there is a case in which the sheet 3 is curled when a path of carrying the sheet 3 is formed to be bent for downsizing the laser printer 1. In order to prevent the sheet 3 from being discharged to the sheet discharge tray 53 in a state of being curled, the above-described discharge roller portion 60 and a curl correcting member 85 selectively arranged on a downstream side thereof are provided with a function for correcting the curl. Now, the sheet discharge tray 53, the discharge roller portion 60 and the curl correcting member 85 will be described in details.

(1) Sheet Discharge Tray

As shown in FIG. 1 and FIG. 2, the sheet discharge tray 53 is formed to be recessed at an upper face of the main body casing 2, a bottom plate thereof is constituted by a rectangular shape and is bent to be lower as proceeding to a rear side. A slope of the sheet discharge tray 53 is comparatively steep on a rear side and is more gradual on a front side. The sheet discharge tray 53 is formed by a size capable of stacking a maximum sheet size (here, A4 size) capable of being dealt with by the laser printer 1. Further, at a rear end of the sheet discharge tray 53, a vertical wall 80 is erected, a horizontal wall 82 is formed to be horizontally extended from a rear face of an upper portion of the vertical wall 80 and the sheet discharge roller portion 60 is arranged on an upper side thereof.

(2) Discharge Roller Portion

Figure 3:
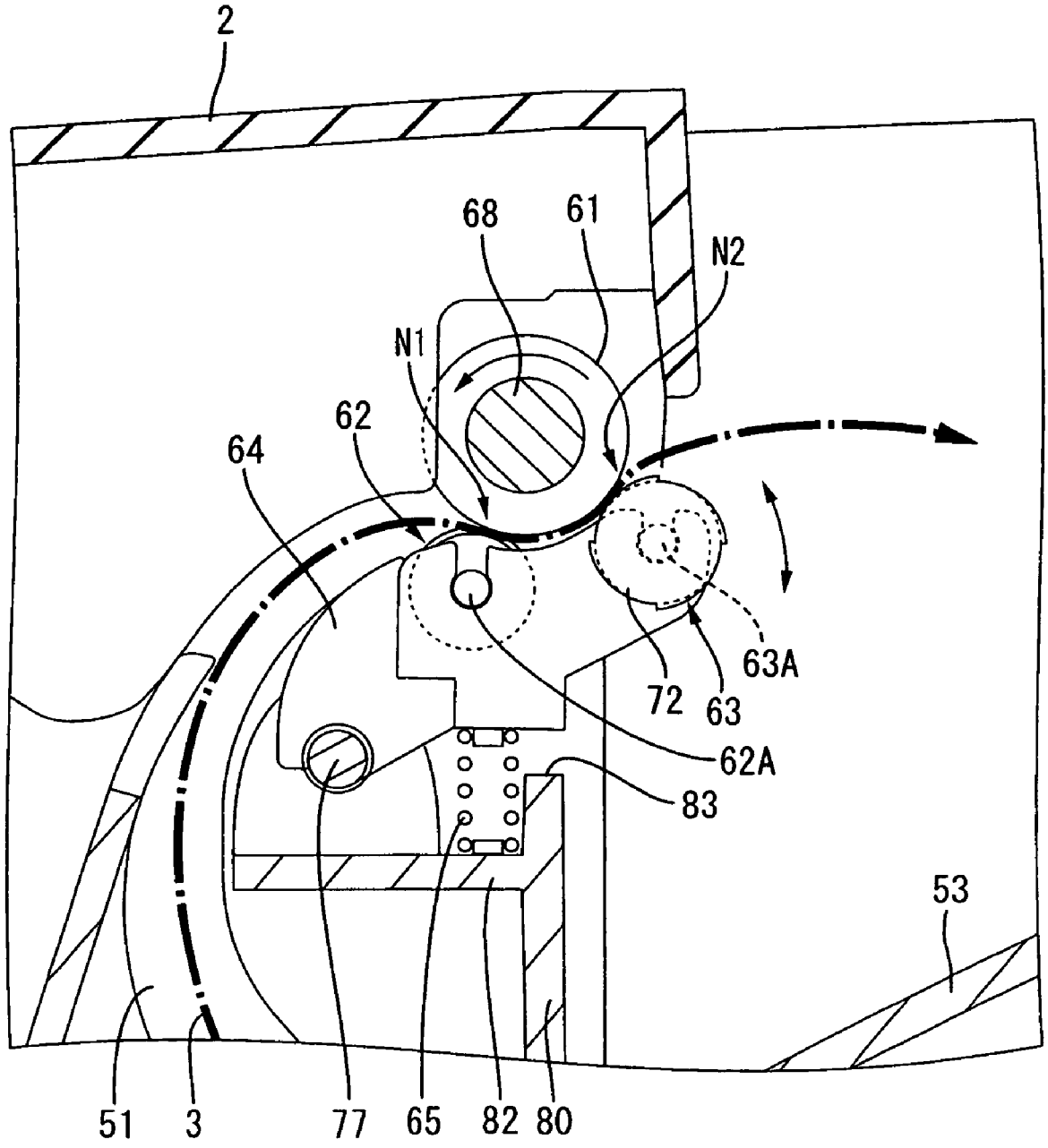
FIG. 3 is a side sectional view showing a discharge roller portion in a state where a curl correcting member is removed.
Figure 4:
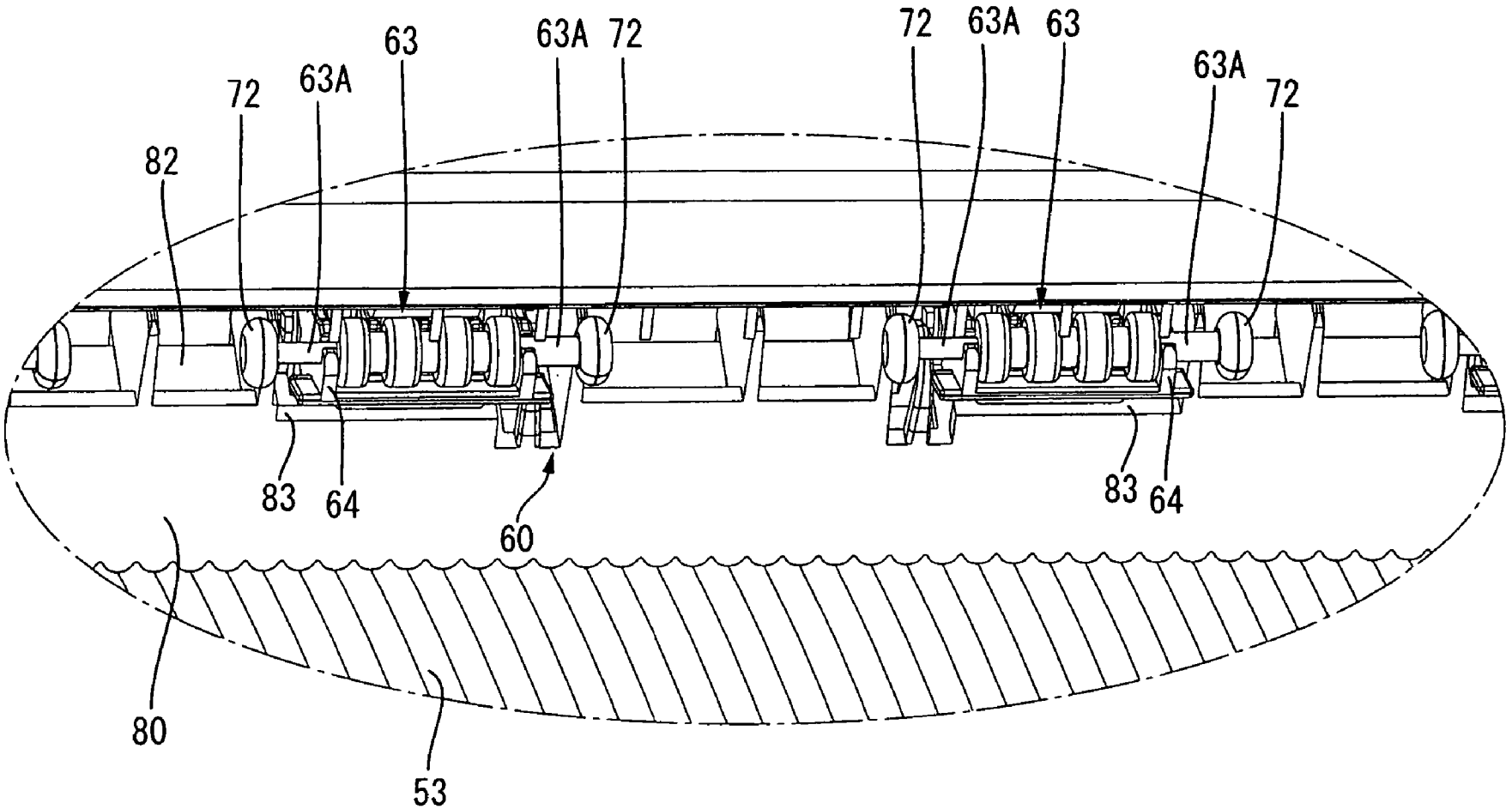
FIG. 4 is a perspective view showing the discharge roller portion in the state where the curl correcting member is removed.

FIG. 3 is a side sectional view of a vicinity of the discharge roller portion 60, and FIG. 4 is a perspective view viewing a center portion of the discharge roller portion 60 from outside. Further, the both drawings show a state where a curl correcting member 85, mentioned later, is removed.

The discharge roller portion 60 is provided with a curl correcting roller 61 driven to rotate, a pair of pressing rollers 62, 63 arranged to be opposed to the curl correcting roller 61 and rotatably provided centering on shafts different from each other, a holder 64 holding the pressing rollers 62, 63 and pivotably displaceable, and a spring member 65 for urging the holder 64 in a direction in which the pressing rollers 62, 63 become proximate to the curl correcting roller 61.

The curl correcting roller 61 is a roller made of rubber attached to a single piece of a shaft portion 68 extended in a direction orthogonal to a direction of carrying the sheet 3 (left and right direction) and is driven to rotate by inputting power from a motor, not illustrated, to the shaft portion 68. Further, two pieces of the curl correcting rollers 61 are arranged symmetrically relative to a center in a width direction of the sheet 3 to be carried (coinciding with a center in a width direction of the sheet discharge tray 53).

The pressing rollers 62, 63 are made of a synthetic resin and respective pairs thereof are provided to be opposed to the respective curl correcting rollers 61. Further, the pair of pressing rollers 62, 63 are referred to as the first pressing roller 62 and the second pressing roller 63 from an upstream side in the direction of carrying the sheet. The respective pressing rollers 62, 63 are made to be able to be driven to rotate by constituting axes thereof by the left and right direction by supporting pairs of shaft portions 62A, 63A extended from both left and right ends thereof by the holder 64. Further, the second pressing rollers 63 are formed with kick out portions 72 in a shape of a circular disk at tip ends of the respective shaft portions 63A. The kick out portion 72 is provided with a function of kicking out a rear end of the sheet 3 passing through between the curl correcting roller 61 and the second pressing roller 63 to a side of the sheet discharge tray 53.

The holder 64 is provided with a holder shaft 77 projected in the left and right direction and the holder shaft 77 is pivotably supported at an upper position of the horizontal wall 82. The holder 64 holds the respective pressing rollers 62, 63 on a free end side thereof and is made to be displaceable to make the two pressing rollers 62, 63 proximate to or remote from the curl correcting roller 61 by being pivoted centering on the roller shaft 77. Further, the spring member 65 is attached between an upper face of the horizontal wall 82 and the holder 64, the free end side of the holder 64 is urged to an upper side by the spring member 65 and the two pressing rollers 62, 63 are pressed to a side of the curl correcting roller 61. Thereby, the sheet 3 carried to the discharge roller portion 60 is nipped at two portions between the first pressing roller 62 and the curl correcting roller 61 (N1) and between the second pressing roller 63 and the curl correcting roller 61 (N2), and is carried in a state of being warped back along an outer circumferential face of the curl correcting roller 61. Further, an upper end of the vertical wall 80 is formed with a recess portion 83 for permitting the holder 64 to displace downward at a position on a lower side of each holder 64.

(3) Curl Correcting Roller

Figure 5:
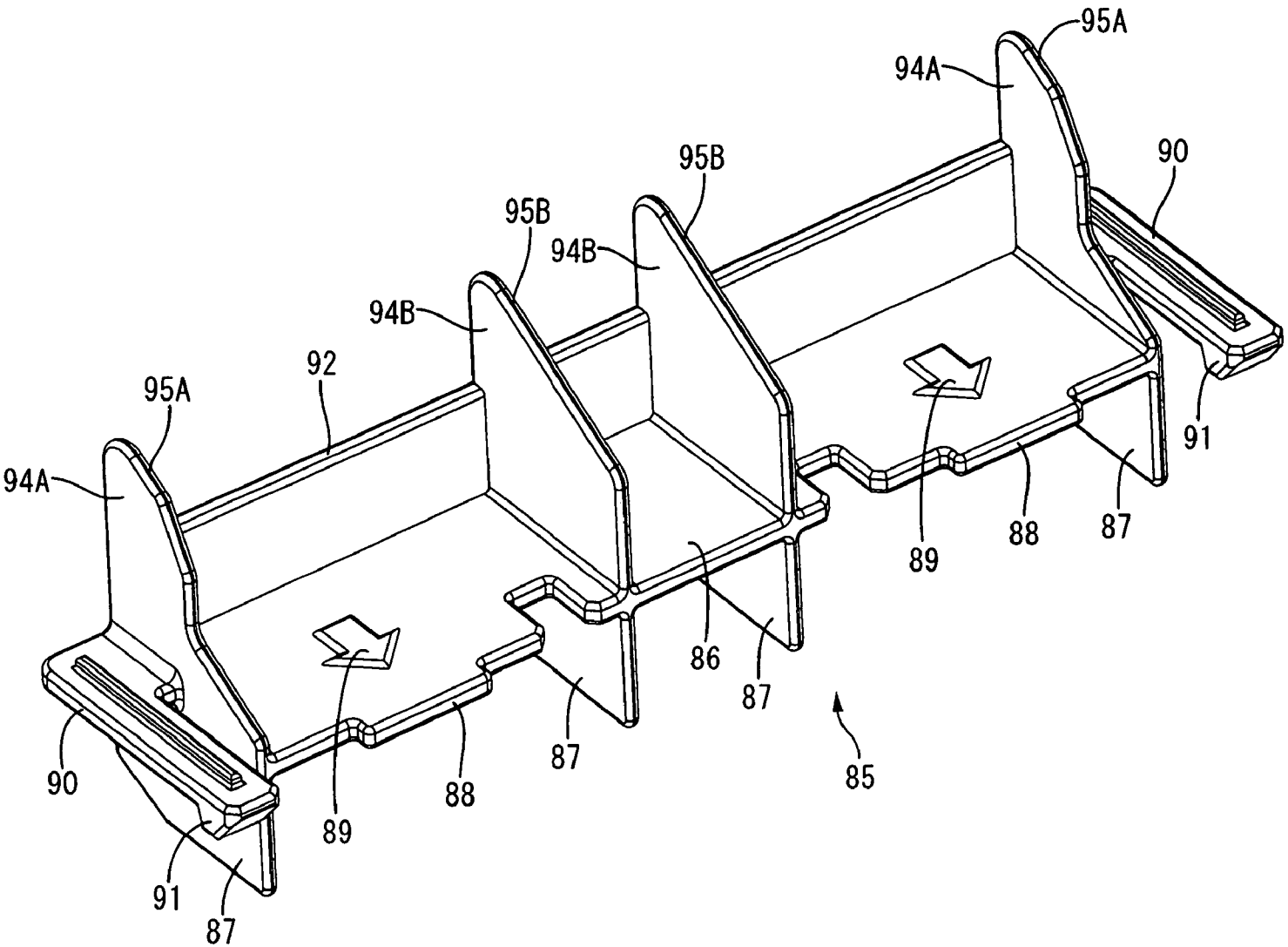
FIG. 5 is a perspective view showing the curl correcting member.
Figure 6:
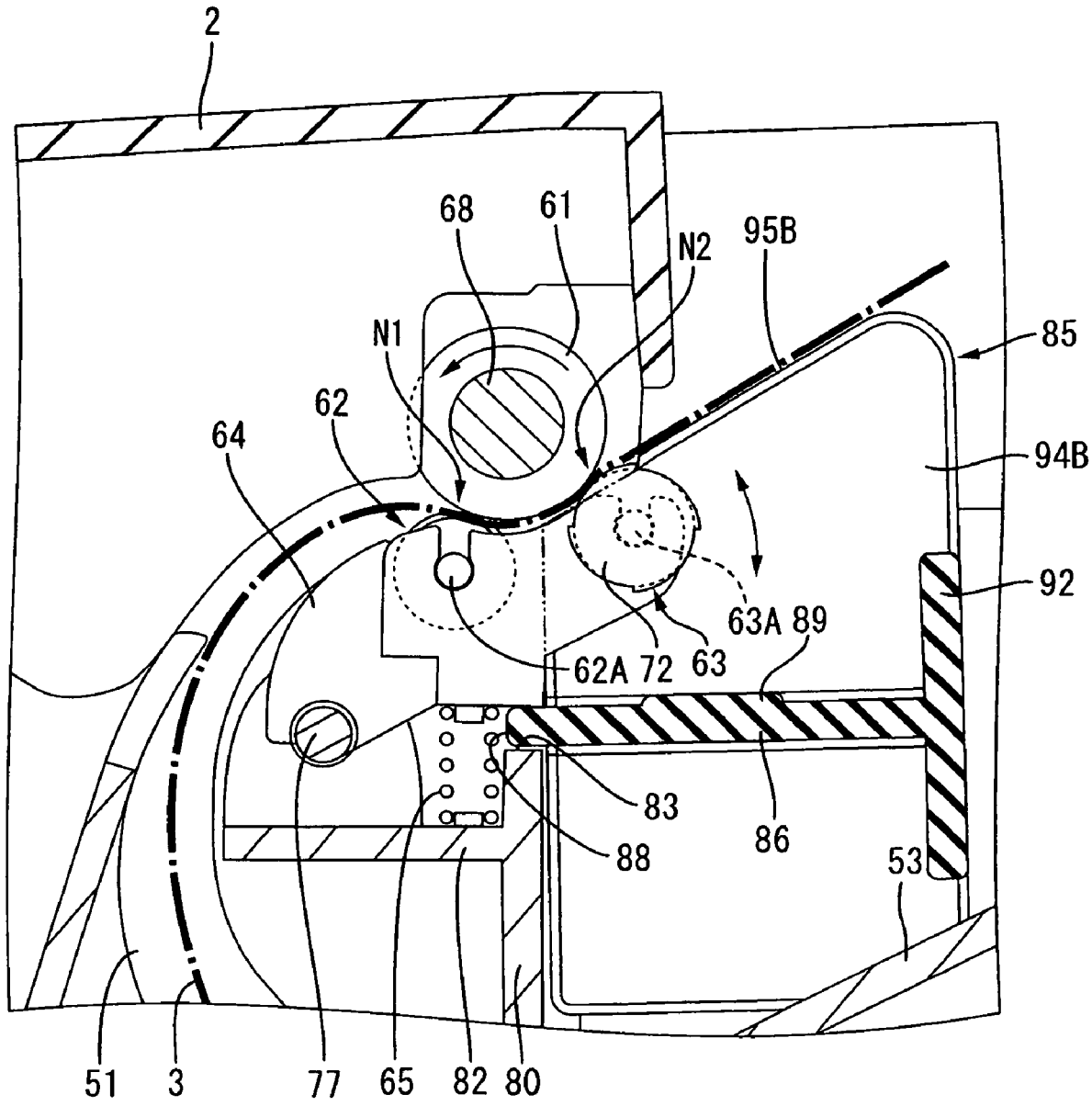
FIG. 6 is a side sectional view showing a state where the curl correcting member is attached on a downstream side of the discharge roller portion.
Figure 7:
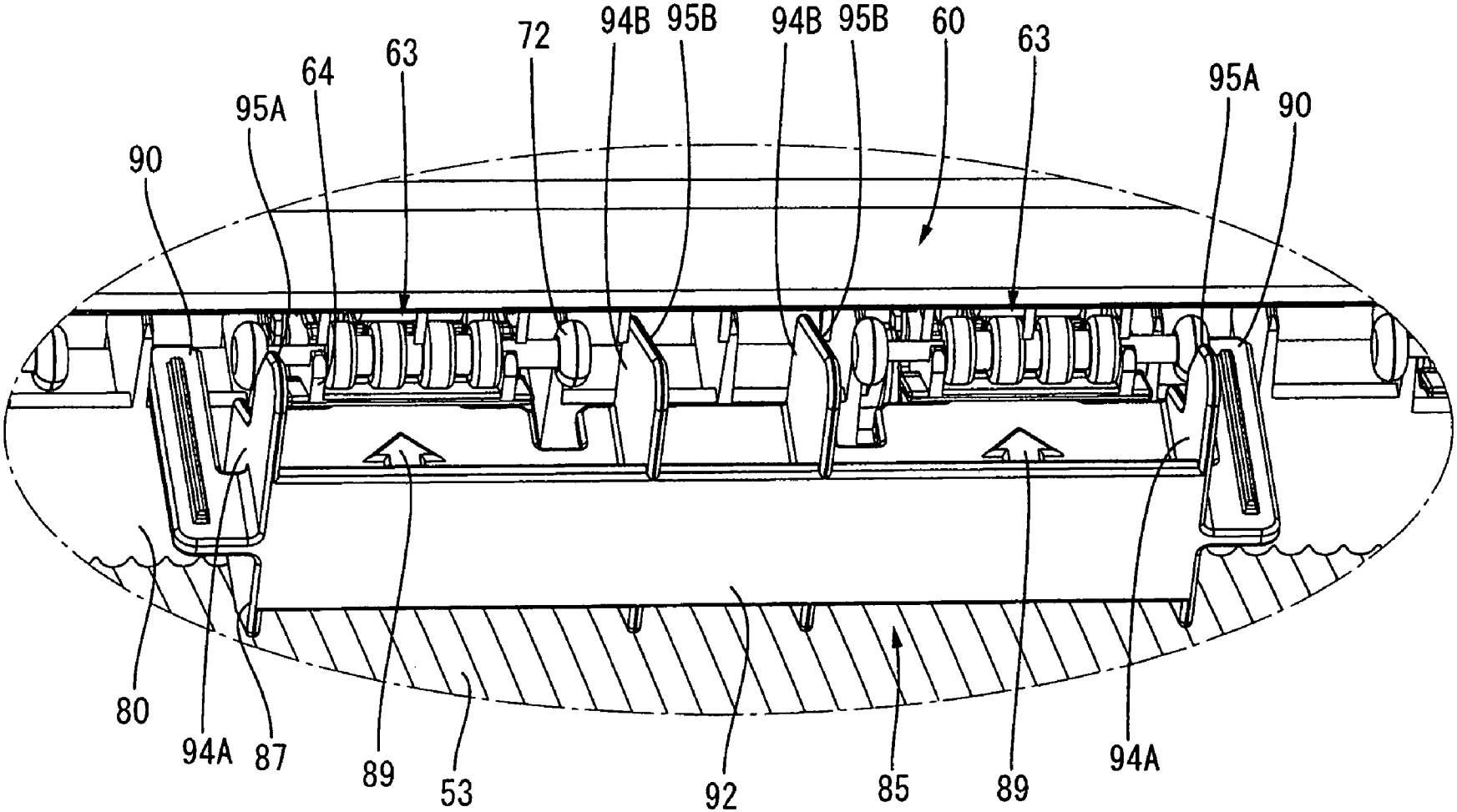
FIG. 7 is a perspective view showing the state where the curl correcting member is attached on the downstream side of the discharge roller portion.

FIG. 5 is a perspective view of a curl correcting member, FIG. 6 is a side sectional view showing a state where the curl correcting member is arranged on a downstream side of the discharge roller portion 60 and FIG. 7 is a perspective view thereof.

The curl correcting member 85 is integrally formed by a synthetic resin material, and is detachably mounted on a downstream side of the discharge roller portion 60 from an upper face of a rear end portion of the sheet discharge tray 53. A width dimension of the curl correcting member 85 is made to be smaller than a maximum sheet width (A4 size) capable of being dealt with by the laser printer 1 and is provided with a width dimension of substantially a size of a postcard in this aspect. The curl correcting member 85 is provided with a base portion 86 in a shape of a horizontal plate slender in a lateral width direction. Further, four leg portions 87 in a plate-like shape are formed to project vertically downwardly from the base portion 86. By mounting the leg portions 87 on the upper face of the rear end portion of the sheet discharge tray 53, the curl correcting member 85 can be arranged in an attitude of making the base portion 86 substantially horizontal. Further, by butting the rear end of the leg portion 87 to the vertical wall 80, the curl correcting member 85 is positioned in a front and rear direction.

A rear end of the base portion 86 is formed with a pair of left and right restricting portions 88 to project to a rear side. The pair of restricting portions 88 and four of the recess portions 83 on the side of the main body casing 2 function as an erroneous attachment preventing unit. That is, the pair of restricting portions 88 are matched to only a pair of the recess portions 83 at center among four of the recess portions 83 to be able to be fitted to each other. When the pair of restricting portions 88 are tried to be fitted to the recess portions 83 at other potions (a pair of the recess portions 83 on a right side or a pair of the recess portions 83 on a left side), the positions of the both members 88, 83 do not match to each other and therefore, the both members 88, 83 cannot be fitted to each other. Further, by fitting the respective restricting portions 88 to the recess portions 83, a displacement of the holder 64 into the recess portion 83 by a predetermined amount or more is restricted. Further, the upper face of the base portion 86 is provided with an arrow mark 89 indicating a direction of attaching the curl correcting member 85 (a direction of fitting the restricting portion 88).

A pair of locking pieces 90 extended to a rear side are provided at left and right side edges of the base portion 86 to expand to outer sides. Tip ends of the respective locking pieces 90 are provided with locking claws 91 to be projected to a lower side. By locking the respective locking claws 91 by an upper end portion of the vertical wall 80, a displacement of the curl correcting member 85 to a front side (displacement in a direction of being remote from the vertical wall 80) is restricted. Further, a front end of the base portion 86 is formed with a rear stop wall 92 in a shape of a vertical plate over a total width of the base portion 86. The rear stop wall 92 functions as a rear stop of the sheet 3 stacked on the sheet discharge tray 53.

An upper face of the base portion 86 is provided with four of plate-like guide portions 94A, 94B to project vertically on an upper side. The guide portions 94A, 94B have a pair of left and right guide portions 94A provided at two left and right end positions of the base portion 86, and a pair of left and right guide portions 94B provided at a vicinity of a center of the base portion 86. Upper ends of the respective guide portions 94A, 94B are formed with correcting faces 95A, 95B respectively extended from a rear side to a front side and inclined front upward by a constant angle. The correcting face 95B provided to the guide portion 94B at a center is provided over a range substantially from a rear end of the leg portion 87 to the rear stop wall 92 in a front and rear direction, arranged slightly on a lower side of the nip position N2 on the downstream side of the discharge roller portion 60, and a rear end of the correcting face 95B is provided on an upstream side of the nip position N2. Further, the correcting faces 95A provided to the guide portions 94A at the two left and right ends are provided only on a front side (downstream side) of the nip position N2 on the downstream side. Further, the respective correcting faces 95A, 95B are arranged at positions upward from the end portion on the upstream side of the sheet discharge tray 53 to constitute a shape of a stepped difference relative to the sheet discharge tray 53. Further, the correcting faces 95A, 95B are set to an inclined angle such that a rear end of the sheet 3 maintains an attitude of being brought into contact with the correcting face 95B without being floated up therefrom immediately after the rear end of the sheet 3 is discharged from the discharge roller portion 60 as mentioned later.

3. Operation and Effect of the Aspect

When an image is formed on the comparatively flexible sheet 3 of an ordinary sheet or the like, as shown in FIG. 3 and FIG. 4, the curl correcting member 85 is detached from the main body casing 2. The sheet 3 carried to the discharge roller portion 60 after passing through the fixing portion 21 is, first, nipped between the curl correcting roller 61 and the first pressing roller 62 (N1) and successively nipped between the curl correcting roller 61 and the second pressing roller 63 (N2). Here, the sheet 3 is pressed to the outer circumferential face of the curl correcting roller 61 by the two pressing rollers 62, 63 urged by the spring member 65 and is warped to a side inverse to a direction of being curled at the fixing portion 21. Therefore, the sheet 3 receives an appropriate correcting force to a side of correcting the curl from the discharge roller portion 60 to correct the curl and thereafter, is discharged onto the sheet discharge tray 53.

Further, when an image is formed on the comparatively inflexible sheet 3 of a postcard or the like, as shown in FIG. 6 and FIG. 7, the curl correcting member 85 is mounted to a downstream side of the discharge roller portion 60. In attaching the curl correcting member, first, front end side portions of the leg portions 87 are mounted to a center at a rear end portion of the sheet discharge tray 53 and the curl correcting member 85 is inclined in an attitude of elevating a rear end thereof slightly. Further, the respective restricting portions 88 are fitted to the corresponding recess portions 83 from a skewed front upper side such that the curl correcting member 85 is inclined to a horizontal attitude, and the respective claws 91 are engaged with the front end portion of the vertical wall 80. In this manner, the curl correcting member 85 is mounted to a center position of the sheet discharge tray 53 in the width direction. When the curl correcting member 85 is tried to be mounted to a position other than the center position erroneously, the respective restricting portions 88 cannot be fitted to the recess portions 83 and the attaching operation is hampered and therefore, an operator can immediately notice the error.

The sheet 3 carried to the discharge roller portion 60 after passing through the fixing portion 21 passes between the curl correcting roller 61 and the two pressing rollers 62, 63 (N1, N2). At this occasion, the sheet 3 receives a stress larger than that in the case of an ordinary sheet and pressed down in a lower direction. Then, the restricting portions 88 of the curl correcting member 85 is brought into contact with a lower end of the holder 64 to restrict a downward displacement of the holder 64 and therefore, the sheet 3 is further firmly pressed to the outer circumferential face of the curl correcting roller 61 by the two pressing rollers 62, 63, and is carried in a state of being warped back to a side inverse to a direction of being curled at the fixing portion 21. Therefore, at the discharge roller portion 60, in comparison with a case in which the discharge roller portion 60 is not mounted with the curl correcting member 85, a large curl correcting force can be exerted to the sheet 3.

Successively, the sheet 3 is discharged to a skewed front upper side from the nip position N2 on the downstream side of the discharge roller portion 60. The curl convex to an upper side remains to some degree in the sheet 3 passing through the discharge roller portion 60 and therefore, the sheet 3 is pressed to the correcting faces 95A, 95B of the curl correcting member 85 by the curl provided to the sheet 3 per se and is guided to a skewed front upper side while being brought into sliding contact with the correcting faces 95A, 95B. Thereby, the sheet 3 receives a correcting force to a side of correcting the curl from the correcting faces 95A, 95B. In this way, the sheet 3 receives a curl correcting force doubly by the discharge roller portion 60 and the curl correcting member 85 and therefore, even in the case of the inflexible sheet 3, the curl can sufficiently be removed. Further, the upstream side end portion of the correcting face 95B is formed on the upstream side of the nip position N2 on the downstream side of the discharge roller portion 60 and therefore, there is not formed a gap for catching the sheet 3 between the nip position N2 and the correcting face 95B. Thus, the sheet 3 can smoothly be carried. Further, although during a time period of bringing the sheet 3 into sliding contact with the correcting faces 95A, 95B, the curl correcting member 85 receives a stress operating in the clockwise direction of FIG. 6 from the sheet 3, however, the restricting portion 88 is held by being pinched in the holder 64 and the vertical wall 80 and therefore, it is prevented that the restricting portion 88 is floated up from the recess portion 83. Thus, detachment of the curl correcting member 85 is prevented.

Figure 8:
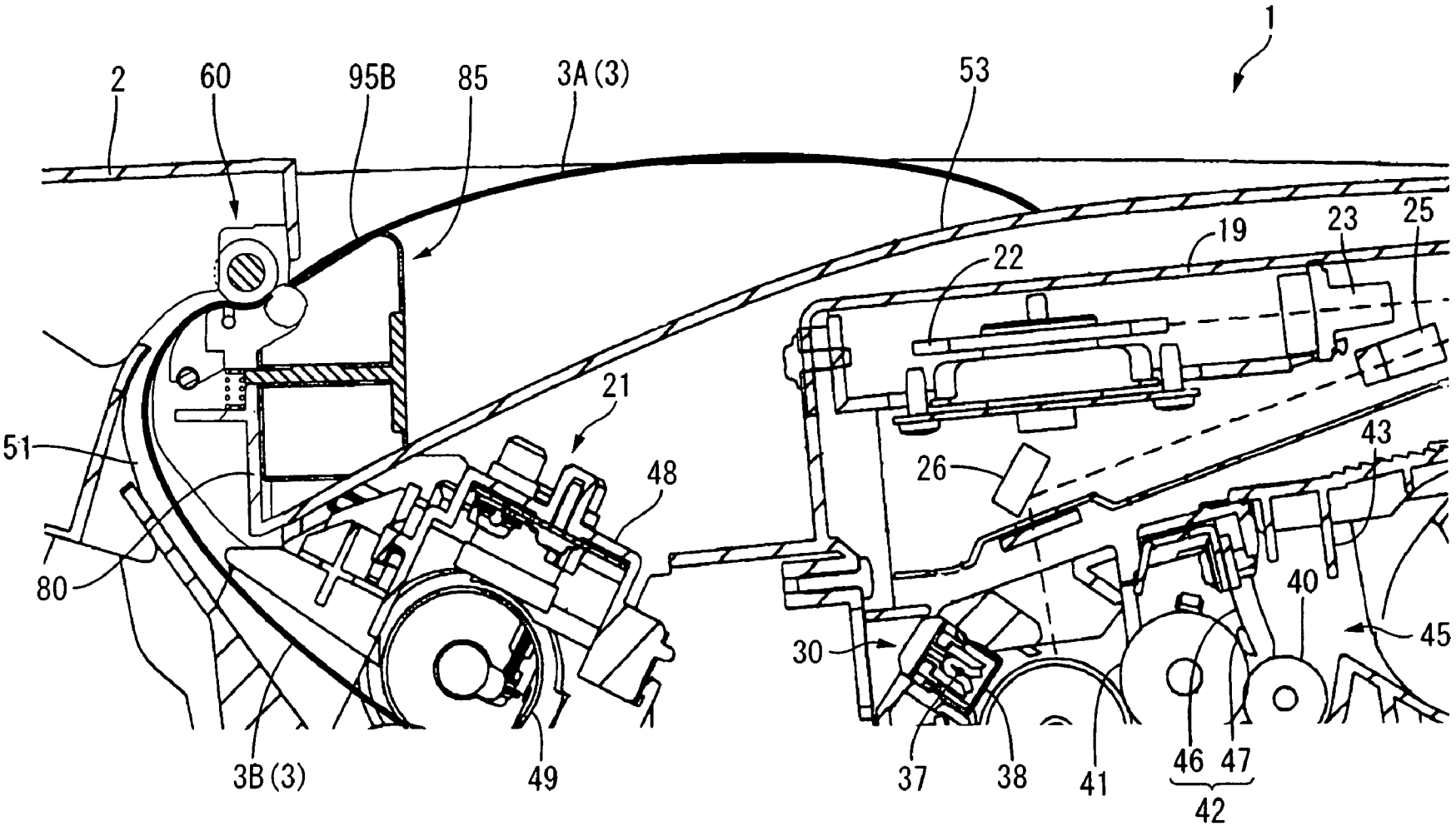
FIG. 8 is a side sectional view showing a state immediately after discharging a first sheet.

When the front end of the sheet 3 is carried further to the front side by passing over the correcting faces 95A, 95B, the front end of the sheet 3 is brought into contact with the sheet discharge tray 53. Further, when the rear end of the sheet 3 passes through the nip position N2 and the discharge roller portion 60, immediately thereafter, as shown in FIG. 8, the front end (forward end) of the sheet 3 is supported by the sheet discharge tray 53 in an attitude of being bent to be convex to the upper side and the rear end is brought into a state of being supported by the correcting faces 95A, 95B of the curl correcting member 85. When a second sheet 3B is carried from the discharge roller portion 60 successive to a first sheet 3A, a front end of the second sheet 3B passing through the nip position N2 is brought into contact with a rear end of the first sheet 3A to press the sheet 3A to a front side. Further, a rear end of the first sheet 3A is dropped onto the sheet discharge tray 53 from the correcting faces 95A, 95B and the sheet 3A is loaded thereon in a state of bringing two front and rear ends thereof into contact with the sheet discharge tray 53. Further, immediately after discharging the sheet 3 from the discharge roller portion 60, the rear end of the sheet 3 is brought into an attitude of being brought into contact with the correcting face 95B without being floated up therefrom. Therefore, it is prevented that the rear end of the preceding sheet 3 is floated up from the correcting face 95B and a front end of the succeeding sheet 3B is brought to between the rear end of the preceding sheet 3A and the correcting face 95B.

Figure 9:
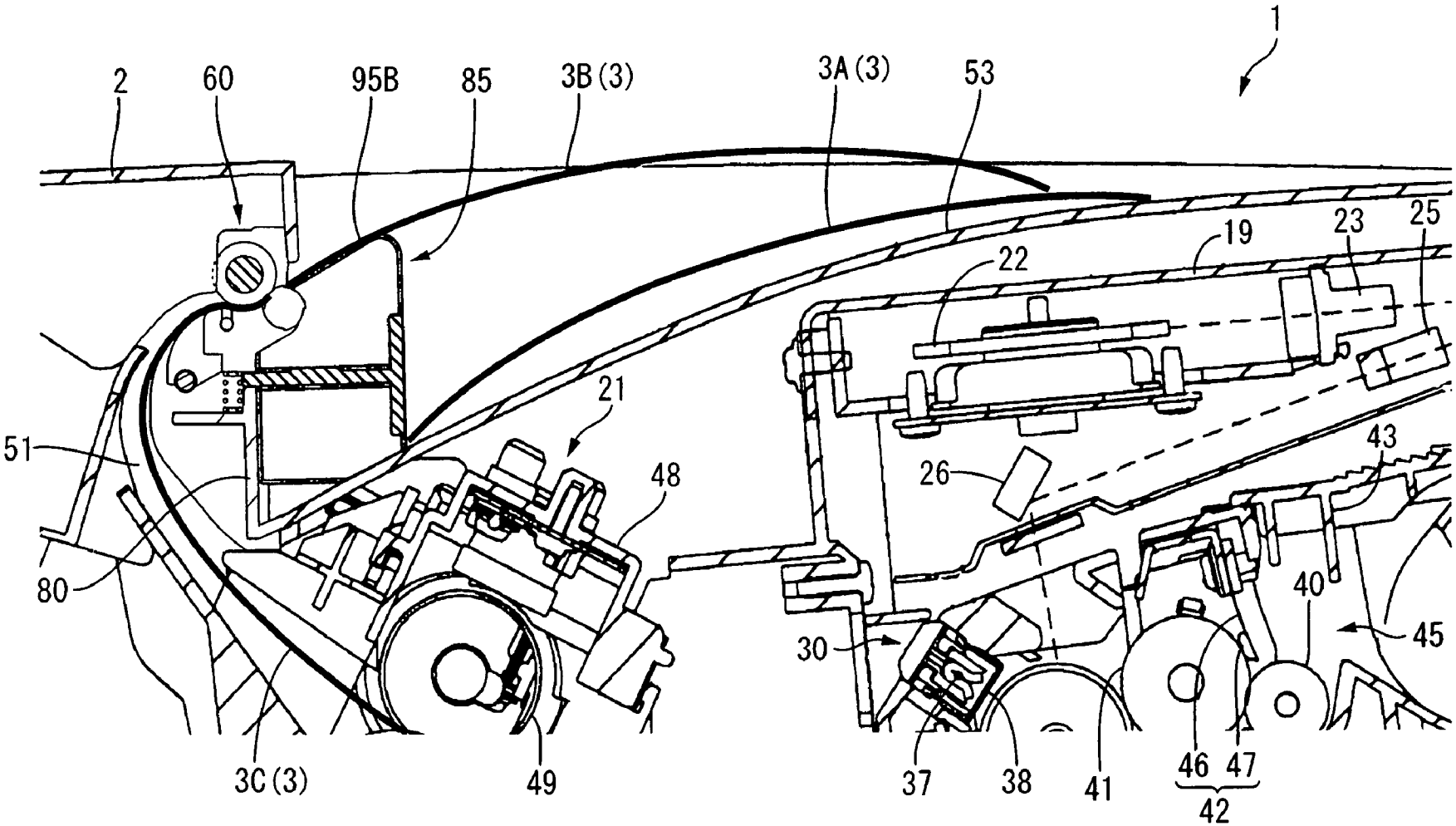
FIG. 9 is a side sectional view showing a state immediately after discharging a second sheet.

Successively, when the front end of the second sheet 3B is carried to the front side by passing over the correcting faces 95A, 95B, as shown in FIG. 9, the front end is brought into contact with a position of the first sheet 3A on the sheet discharge tray 53 proximate to the front end. Therefore, the succeeding sheet 3B does not push out the preceding sheet 3A from the sheet discharge tray 53. When a third sheet 3C is carried from the discharge roller portion 60, a rear end portion of the second sheet 3B is dropped onto the sheet discharge tray 53 from the correcting faces 95A, 95B to be stacked on an upper face of the first sheet 3A.

As described above, according to the aspect, with regards to the sheet 3 which is in flexible and needs a large curl correcting force, the curl correcting member 85 is arranged on the downstream side of the discharge roller portion 60. With regard to the other sheet 3, the curl correcting member 85 is retracted (removed) from the downstream side of the discharge roller portion 60. Thus, a curl correcting force exerted to the sheet 3 can pertinently be adjusted. Thereby, the appropriate curl correcting force can be exerted to a plurality of kinds of the sheets 3.

The curl correcting member 85 is constituted to be detachably attached to the main body casing 2 and therefore, in comparison with a constitution which cannot be attached to and detached therefrom, a structure on a side of the main body casing 2 can be simplified.

Further, the restricting portion 88 and the recess portion 83 are provided between the main body casing 2 and the curl correcting member 85 as the erroneous attachment preventing unit for hampering the curl correcting member 85 from being attached to other than the regular attaching position. Therefore, when the curl correcting member 85 is narrower in a width thereof than a maximum width of the sheet 3 which can be dealt with by the curl correcting member 85, the attaching position can be prevented from being incorrect with regard to the width direction.

Further, the main body casing 2 is provided with the discharge roller portion 60 as a correcting unit for exerting the curl correcting force of the sheet 3 other than the curl correcting member 85. Therefore, even in a state of removing the curl correcting member 85 from the downstream side of the discharge roller portion 60 depending on the kind of the sheet 3, the curl can sufficiently be removed only by the correcting unit.

Further, the correcting unit (discharge roller portion 60) exerts the correcting force on a side the same as that of the curl correcting member 85 to the sheet 3. Therefore, by simultaneously using the curl correcting member 85 and the correcting means, the curl correcting force exerted to the sheet 3 can be increased.

Further, when the pressing rollers 62, 63 are pressed to a side of being remote from the curl correcting roller 61 by the sheet 3, the holder 64 holding the pressing rollers 62, 63 is restricted from being escaped by the restricting portion 88. Therefore, the curl correcting function at the discharge roller portion 60 can be increased. Further, since the restricting portion 88 is provided to the curl correcting member 85, in the case in which a strong curl correcting force is needed, when the curl correcting member 85 is arranged on the downstream side of the discharge roller portion 60, the curl correcting force of the discharge roller portion 60 can be increased simultaneously with achieving the curl correcting force by the correcting faces 95A, 95B. Thus, the usability is excellent.

Further, the rear end portion of the sheet 3 immediately after being discharged from the discharge roller portion 60 is pressed by the succeeding sheet material to be dropped from above the correcting faces 95A, 95B to above the sheet discharge tray 53. Therefore, when images are formed on a plurality of sheets 3, with regard to the preceding sheet 3, the rear end portion does not stay to be mounted on the correcting faces 95A, 95B and the sheets are stacked in a state of being dropped onto the discharge tray 53. Thus, the sheet stacking characteristics can be ensured.

When the rear end of the sheet 3A is brought into a state of being floated up from the correcting faces 95A, 95B immediately after being discharged from the discharge roller portion 60, there is a concern that an order of stacking the sheets 3 is switched by bringing the front end of the succeeding sheet 3B to between the rear end of the sheet 3A and the correcting faces 95A, 95B. In contrast thereto, according to the constitution, the rear end of the sheet 3 is supported in a state of being brought into contact with the correcting face 95B immediately after being discharged from the discharge roller portion 60. Therefore, the order of stacking the sheets 3 can be prevented from being switched.

When there is a gap between the nip position N2 of the discharge roller portion 60 and the correcting face 95B of the correcting member 85, there is a concern of catching the sheet 3 by the gap. According to the constitution, the upstream side end portion of the correcting face 95B is arranged on the upstream side of the nip position N2 and therefore, the gap is not produced between the nip position N2 and the correcting face 95B. Thus, the sheet 3 can smoothly be carried.

<Other Aspect>

The invention is not limited to the aspect explained by the description and the drawings, mentioned above. For example, following aspects are included in the technical scope of the invention. Further, the invention can be embodied by being variously changed within the scope not deviated from the gist other than described below. (1) Although there is shown a constitution in which the curl correcting member is made to be detachably attached to the apparatus main body, according to the invention, the curl correcting member may be not detachably attached to the apparatus main body so long as it can be retracted from the position on the downstream side of the discharge roller portion. (2) Although there is shown the curl correcting member used in the case of using a postcard as a sheet member, according to the invention, a plurality of kinds of curl correcting members having different width dimensions and angles of correcting faces to be able to deal also with other kinds of sheet materials may be used. Also, a single piece of the curl correcting member may be made to be able to pertinently adjust a position of a correcting face.

What is claimed is:

1. An image forming apparatus comprising:

an apparatus main body;

a discharge roller portion that discharges sheet members;

a tray being capable of stacking the sheet members discharged from the discharge roller portion;

a curl correcting member movably disposed downstream of where a sheet member is discharged, for contacting the sheet member discharged from the discharge roller portion, and having a correcting face for exerting a first correcting force to a side of the sheet member to correct an upward curl of the sheet member; and a curl correcting unit disposed in the apparatus main body for exerting a second correcting force to the sheet member to correct the convex curl of the sheet member, wherein the curl correcting member is movable from a first position where the curl correcting member contacts the sheet member to a second position where the curl correcting member does not contact the sheet member.

2. The image forming apparatus according to claim 1, wherein the curl correcting member is detachably or retractably attached to the apparatus main body, wherein the curl correcting member is configured to be detached or retracted to the second position when exerting the first curl correcting force is not necessary.

3. The image forming apparatus according to claim 2, further comprising an erroneous attachment preventing unit provided between the apparatus main body and the curl correcting member;

wherein the curl correcting member has a width dimension smaller than a maximum width of the sheet member that can be handled by the image forming apparatus, and the erroneous attachment preventing unit enables the curl correcting member to be attached to a regular attaching position and prevents the curl correcting member from being attached to other than the regular attaching position.

4. The image forming apparatus according to claim 1, wherein the curl correcting unit exerts the second correcting force on the same side of the sheet member as the curl correcting member exerts the first correcting force.

5. The image forming apparatus according to claim 4, wherein the correcting unit is disposed in the discharge roller portion and the discharge roller portion comprises:

a curl correcting roller driven to rotate;

a plurality of pressing rollers arranged to be opposed to the curl correcting roller for carrying the sheet member along an outer circumferential face of the curl correcting roller while pinching the sheet member between the plurality of pressing rollers and the curl correcting roller;

a holder holding at least one of the pressing rollers and capable of being displaced in a direction of making the pressing rollers proximate to and remote from the curl correcting roller; and a spring member for urging the holder in a direction of making the pressing rollers proximate to the curl correcting roller;

wherein the curl correcting member is provided with a restricting portion capable of restricting a displacement of the holder away from the curl correcting roller.

6. The image forming apparatus according to claim 1, wherein the correcting face of the curl correcting member is arranged at a position above an upstream side end portion of the tray and configured to drop a rear end portion of the sheet member onto the tray from the correcting face, immediately after the sheet member is discharged from the discharge roller portion, by pressing the rear end portion with a successive sheet member.

7. The image forming apparatus according to claim 1, wherein the curl correcting member supports a rear end of the sheet member on the correcting face, immediately after the sheet member is discharged from the discharge roller portion, when a front end of the sheet member is supported on the tray.

8. The image forming apparatus according to claim 1, wherein an end portion on an upstream side of the correcting face of the curl correcting member is arranged on an upstream side of a position of nipping the sheet member in the discharge roller portion.

9. An image forming apparatus, comprising:

an apparatus main body;

a discharge roller;

a plurality of pressing rollers arranged in an axial direction of the discharge roller and opposed to the discharge roller, respectively, wherein the discharge roller rotates to discharge a sheet member while the sheet member is pinched between the discharge roller and the plurality of pressing rollers; and a curl correcting member including an extending surface, and disposed at a position such that the extending surface is between the plurality of pressing rollers in the axial direction of the plurality of pressing rollers, and a part of the extending surface is opposed to the discharge roller, wherein the curl correcting member is movable from a first position where the curl correcting member contacts the sheet member to a second position where the curl correcting member does not contact the sheet member.

* * * * *